United States Patent [19]

Graff

[11] Patent Number: 4,778,585

[45] Date of Patent: Oct. 18, 1988

[54] TWO-STAGE PYROLYSIS OF COAL FOR PRODUCING LIQUID HYDROCARBON FUELS

[75] Inventor: Robert A. Graff, Spring Valley, N.Y.

[73] Assignee: Research Foundation of the City Univ. of NY, New York, N.Y.

[21] Appl. No.: 840,698

[22] Filed: Mar. 18, 1986

Related U.S. Application Data

[63] Continuation-in-part of Ser. No. 514,153, Jul. 14, 1983, abandoned.

[51] Int. Cl.[4] ..... C10G 1/00; C10G 1/04; C10B 57/12

[52] U.S. Cl. ..... 208/403; 208/430; 208/951; 201/36; 201/37; 201/38

[58] Field of Search ..... 208/403, 430, 951; 201/36, 37, 38

[56] References Cited

U.S. PATENT DOCUMENTS

| | | | |
|---|---|---|---|
| 1,949,891 | 3/1934 | Waterman | 208/8 R |
| 1,954,096 | 4/1934 | Pier et al. | 208/8 R |
| 2,851,397 | 9/1958 | Raineau et al. | 208/8 R |
| 3,441,480 | 4/1969 | Ban | 201/22 |
| 3,715,301 | 2/1976 | Tassoney et al. | 208/8 |
| 3,808,119 | 4/1974 | Bill et al. | 208/8 |
| 3,960,700 | 6/1976 | Rosen et al. | 208/8 R |
| 3,997,423 | 12/1976 | Greene | 208/8 |
| 4,013,543 | 3/1977 | Greene | 208/50 |
| 4,104,129 | 8/1978 | Fields et al. | 201/17 |
| 4,162,959 | 7/1979 | Duroiswomy | 208/8 R |
| 4,189,374 | 2/1980 | Kirby et al. | 208/8 LE |
| 4,206,033 | 6/1980 | Neavel et al. | 208/8 LE |
| 4,213,826 | 7/1980 | Eddinger et al. | 201/31 |
| 4,218,303 | 8/1980 | Finn et al. | 208/8 R |
| 4,383,912 | 5/1983 | Loodi et al. | 208/11 R |
| 4,439,306 | 3/1984 | Voetter et al. | 208/11 R |

OTHER PUBLICATIONS

Acs Dir. Fuel Chem. Preprints, vol. 31, No. 4, 1986, Anaheim, CA, 7-12 Sep. 1986, pp. 321-330.

Electric Power Research Institute Project Report EPRI AP-4531 Project 2147-9 Final Report May 1986, prepared by Purdue Univ., West Lafayette, Ind.

*Primary Examiner*—Helen M. S. Sneed

*Assistant Examiner*—William G. Wright

[57] ABSTRACT

Increased yields of liquid hydrocarbon are obtained from a carbonaceous material (e.g., coal) by a two-stage process comprising pretreatment of the carbonaceous material with an appropriate gas in a first stage, followed by pyrolysis of the pretreated carbonaceous material, in a second stage.

18 Claims, 2 Drawing Sheets

TWO-STAGE PYROLYSIS OF COAL FOR PRODUCING LIQUID HYDROCARBON FUELS

RELATED APPLICATION

This application is a continuation-in-part of application Ser. No. 514,153 filed July 14, 1983, now abandoned.

FIELD OF THE INVENTION

This invention relates generally to the pyrolysis of carbonaceous materials such as coal, and is particularly related to a two-stage method of coal pyrolysis to produce synthetic liquid fuels. In one of its specific aspects, the present invention is directed to a two-stage pyrolysis process wherein the coal is first treated with an appropriate gas prior to pyrolysis in order to maximize the yield of synthetic liquid fuels.

BACKGROUND OF THE INVENTION

Pyrolysis or so-called carbonization of coal is widely known. As disclosed in U.S. Pat. No. 4,104,129 which issued to Fields et al on Aug. 1, 1978, coal may be heated at elevated temperatures of 500° C.–1500° C. to thereby convert it to solid carbonaceous residue known as char, gaseous products containing significant amount of hydrogen and liquid containing large proportions of aromatics and heterocyclics. The process is generally known as coal carbonization or pyrolysis. The Field et al patent describes a coal carbonization-desulfurization process for reducing the sulfur content of the coal to produce a low sulfur coal which is more acceptable commercially and less objectionable environmentally.

The hydrocarbons produced from coal pyrolysis are usually of low economic value due to their high carbon-to- hydrogen ratio and their tendency to self-polymerize because of presence of olefinic and acetylenic hydrocarbons. U.S. Pat. No. 4,162,959 which issued to Kandaswamy Duraiswamy on July 31, 1979 describes a method whereby the low value hydrocarbon products of coal pyrolysis may be upgraded, thereby improving the economy of coal pyrolysis. The process described in this patent initially involves oxidation of a carbonaceous material in an oxidation zone to produce hot particulate char. This hot char is then reacted with steam in a conversion zone to produce hydrogen. The hot char and hydrogen so produced are then combined with carbonaceous material and the carbonaceous material is pyrolyzed with steam, in the presence of hydrogen, in a pyrolysis zone. The steam is injected into the pyrolysis zone to produce more hydrogen for use in hydrogenating the volatilized hydrocarbons.

Other patents of interest include U.S. Pat. Nos. 3,481,834; 3,960,700; 3,997,423; 4,012,311; 4,013,543; 4,189,374; 4,206,033; 4,213,826 and 4,218,303. These patents and the patents referred to therein are by no means exhaustive but are representative of the numerous patents and publications which relate, in one way or another, to coal carbonization, pyrolysis or liquefaction. In general, in order to obtain more valuable liquid hydrocarbons from coal carbonization, the prior art methods either resort to catalytic processes, hydropyrolysis (i.e., pyrolysis in the presence of hydrogen) or combination of these methods. It can be appreciated, therefore, that any such process which does not require a catalyst and whereby increased yields of liquid hydrocarbons (synthetic liquid fuels) can be obtained without a hydrogen feed gas, offers a more attractive alternative from practical and commercial standpoints.

Accordingly, it is an object of this invention to provide a method for liquefaction of coal to obtain liquid hydrocarbons having substantial fuel value, e.g., synthetic liquid fuels, or more simply "synfuels".

It is a further object of this invention to provide a method involving pyrolysis of coal whereby large yields of liquid hydrocarbons are obtained without the use of a catalyst.

It is still another object of this invention to provide an improved coal pyrolysis process whereby large yields of synfuels are obtained without resorting to an external source of hydrogen gas.

The foregoing and other objects, features and advantages of this invention will be more fully appreciated from the following detailed description of the invention and the accompanying drawings.

SUMMARY OF THE INVENTION

The process of this invention comprises a first stage wherein a carbonaceous material (e.g., coal) is preheated or pre-conditioned in the presence of steam or some other appropriate pretreatment gas, at a temperature of from about 280° C. to about 370° C., pressure of from about 1 to about 100 atmospheres, for about a fraction of a second to about 30 minutes. The pretreated coal is then pyrolyzed in a second stage at the selected pyrolysis temperature in the presence of steam or some other appropriate gas. A typical pyrolysis temperature is from about 500° C. to about 1000° C., pressure of from about 1 to about 100 atmospheres, for about a fraction of a second to about 30 minutes. Preferred temperatures under these conditions are from 600° C. to 800° C. The volatiles are withdrawn from the pyrolysis zone and separated into liquid and gaseous fractions, and the residual char is removed from this zone.

The process does not require a catalyst nor is it necessary to employ hydrogen either in the pretreatment stage or during pyrolysis. The yield of hydrocarbon liquids from the pyrolysis of coal is markedly increased when the coal is pretreated as compared to the yield of hydrocarbon liquids obtained by pyrolysis of coal without pretreatment in accordance with this invention.

DETAILED DESCRIPTION OF THE INVENTION

In accordance with the present invention, the yield of synfuels obtained from coal pyrolysis can be markedly improved by pretreatment of the coal prior to its pyrolysis. Thus, the invention broadly encompasses a first stage wherein the coal is pretreated and a second stage wherein the pretreated coal is pyrolyzed. The invention will now be described in detail with reference to FIG. 1, which is a simplified schematic flow representation of the process.

Figure 1:
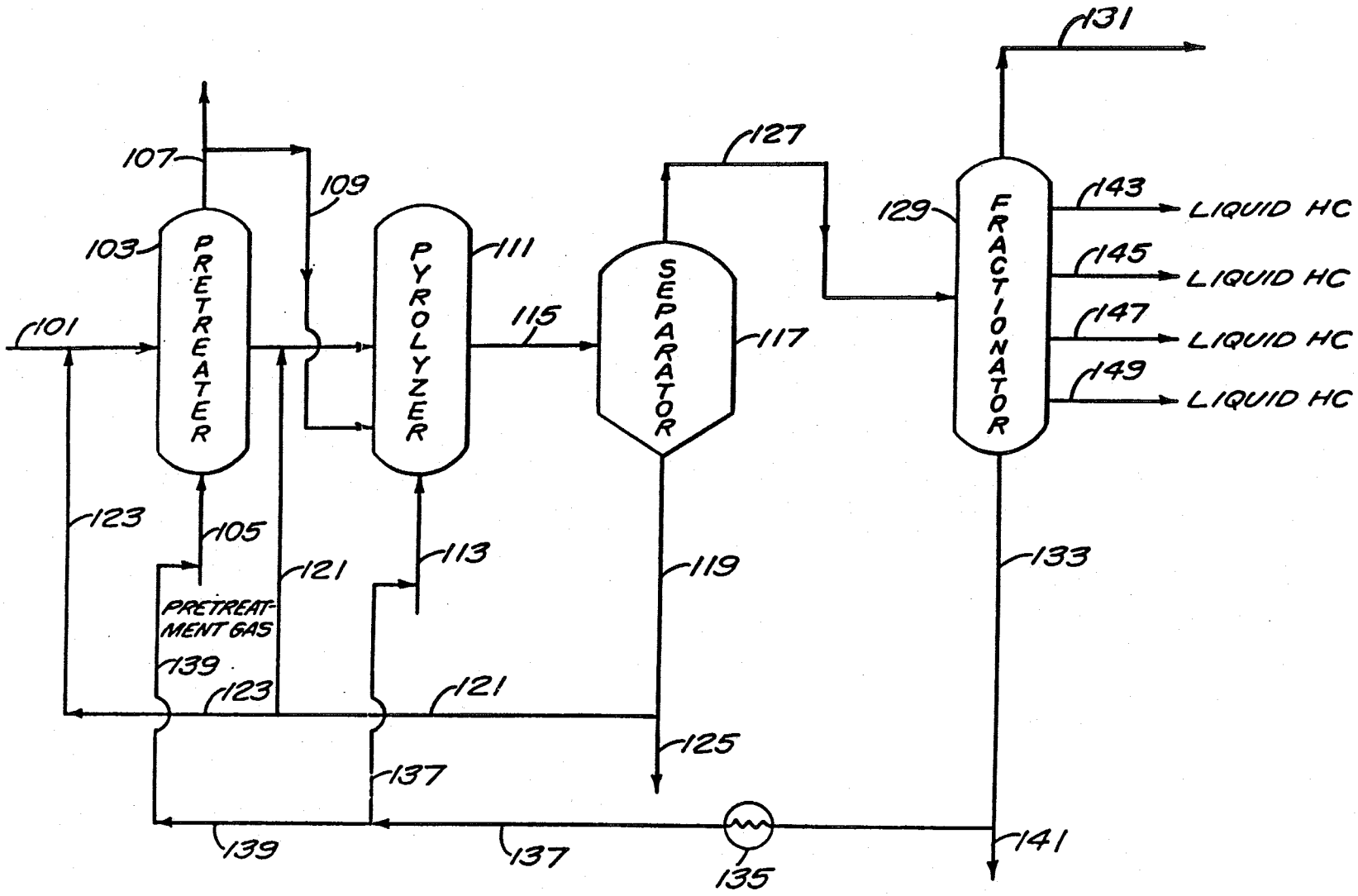
FIG. 1 is a schematic flow diagram of the two-stage process of this invention.

Referring now to FIG. 1, the carbonaceous solid feed (e.g., coal) is introduced by coal feed line 101 to a pretreator 103. Prior to its introduction to the pretreater 103, the coal is ground to the desired particle size using standard equipment and techniques well known to those skilled in the art. Preferably, the coal is ground under an inert atmosphere. When it is desired to feed the coal as a slurry, the coal is mixed with water, which is peferably deoxygenated and a slurry pump may be used to pump the coal slurry into the pretreater 103.

In the pretreater 103, the coal is contacted with steam introduced therein via line 105, at a pressure of from about 1 to about 100 atmospheres, or even higher, preferably from about 30 to about 80 atmospheres, for a fraction of a second to about 30 minutes, preferably from about 1 second to about 15 minutes, at a temperature of from about 280° C. to about 370° C. The preferred range, because it is operative with most carbonaceous materials is from 320° C. to 370° C. While pretreatment with steam is preferable, other gases may be used in lieu of steam. Such gases include inert gases such as helium or nitrogen, or other gases such as carbon monoxide, or mixture of such gases with or without steam.

When pretreating solid coal, the pretreatment may be conveniently carried out under fluid bed conditions, particularly a high velocity fluidized bed, in order to prevent agglomeration of the coal particles. Alternatively, the pretreatment of the coal may be carried out in a moving bed with agitation.

Off gases from the pretreater 103 are removed through line 107 and may be processed to remove methane and other light gaseous and liquid hydrocarbons. Alternatively, the off gases (particularly if steam is used as the pretreating gas) may be introduced via line 109 to the pyrolyzer 111. In the pyrolyzer 111, the pretreated coal is pyrolyzed with steam, an inert gas such as helium or nitrogen, another gas such as carbon monoxide, combustion gases or pyrolysis gases introduced therein through line 113, at a pressure of from about 1 to about, 100 atmospheres, or even higher, preferably from about 30 to 80 atmospheres, a temperature of from about 500° C. to about 1000° C., or even higher, preferably from about 600° C. to about 800° C., for about a fraction of a second to about 30 minutes, preferably from about 1 second to about 15 minutes. The pressure in the pyrolyzer 111 may be the same or slightly lower than the pressure in the preheater 103 to facilitate material transfer without the need for auxiliary equipment.

As in the pretreatment step, the pyrolysis of coal can be conveniently effected under fluid bed conditions.

It must be noted that the pyrolysis time depends on the pyrolysis temperature. Generally, as the pyrolysis temperature is increased, less time is required to obtain the same amount of liquid hydrocarbons during the pyrolysis. Conversely, if the pyrolysis temperature is lower, the pyrolysis time must be increased in order to achieve the same yield of liquid hydrocarbons.

The processing conditions described herein are those which are generally applicable to typical carbonaceous materials. However, the chemical and physical structure of carbonaceous materials vary appreciably from one to the other. For most carbonaceous material, the optimum processing range will be within the ranges defined above. However, with certain materials, the pretreatment temperature range may be somewhat more narrow than that described. Those skilled in the art will have no difficulty in determining the optimum ranges for a specific carbonaceous product. For example, with Illinois No. 6 bituminous coal, the range is from 320° to 360° C.

The pyrolyzed coal and the gases produced during pyrolysis are conducted via transfer line 115 to a separator 117 which can be a cyclone or some other similar device. Residual char produced during pyrolysis is removed from the separator 117 through line 119 and may be recycled totally or in part to the pyrolyzer 111 or preheater 103 through lines 121 or 123, if desired. If not recycled as aforesaid, the residual char may be discharged via line 125. Also, the residual char withdrawn from the separator 117 may be used as a source of fuel to provide heat for raising the temperature of the steam used in the process The vapors from the separator are removed through line 127 and are separated by partial condensation or fractionation as in fractionator 129. In the fractionator 129 the uncondensed vapors are removed via line 131 and water is withdrawn through line 133. Water from fractionator 129 may be heated to steam in heater 135 and may be recycled to the pyrolyzer 111 by line 137 and/or to pretreater 103 through line 139. If not recycled, water may be dicharged through line 141.

The gas removed from the fractionator 129 generally contains carbon monoxide, carbon dioxide, hydrogen, methane and other light hydrocarbon gases. If desired, all or part of this gas may be cycled to the pyrolyzer.

Liquid hydrocarbon fuels produced in the pyrolyzer 111 are fractionated into several streams such as streams 143, 145, 147, 149 according to their boiling points. These liquid streams are valuable synthetic fuels and may be used directly for this purpose. If desired, some or all of these liquid fractions may be upgraded such as by hydrogenation, some may be recycled to the pyrolyzer 111 and some may be burned directly to provide process heat to thereby improve the overall energy balance.

Thus, as shown in FIG. 1, the present invention provides a method of producing synfuels from carbonaceous solids by a two-stage process which comprises a first stage whereby the carbonaceous material is pretreated under suitable pretreatment conditions, followed by a second stage during which the pretreated carbonaceous material is pyrolyzed in the presence of steam. The yields of liquid hydrocarbon fuels obtained by the process of this invention are generally over 50 percent whereas, under comparable conditions but without pretreatment, pyrolysis of similar carbonaceous materials yield no more than about 20 to 25 percent liquid hydrocarbon fuels. This increase in hydrocarbon liquid fuels yield is both significant and surprising and, accordingly, the process of this invention offers a feasible and commercially more attractive route than the hitherto existing processes.

Figure 2:
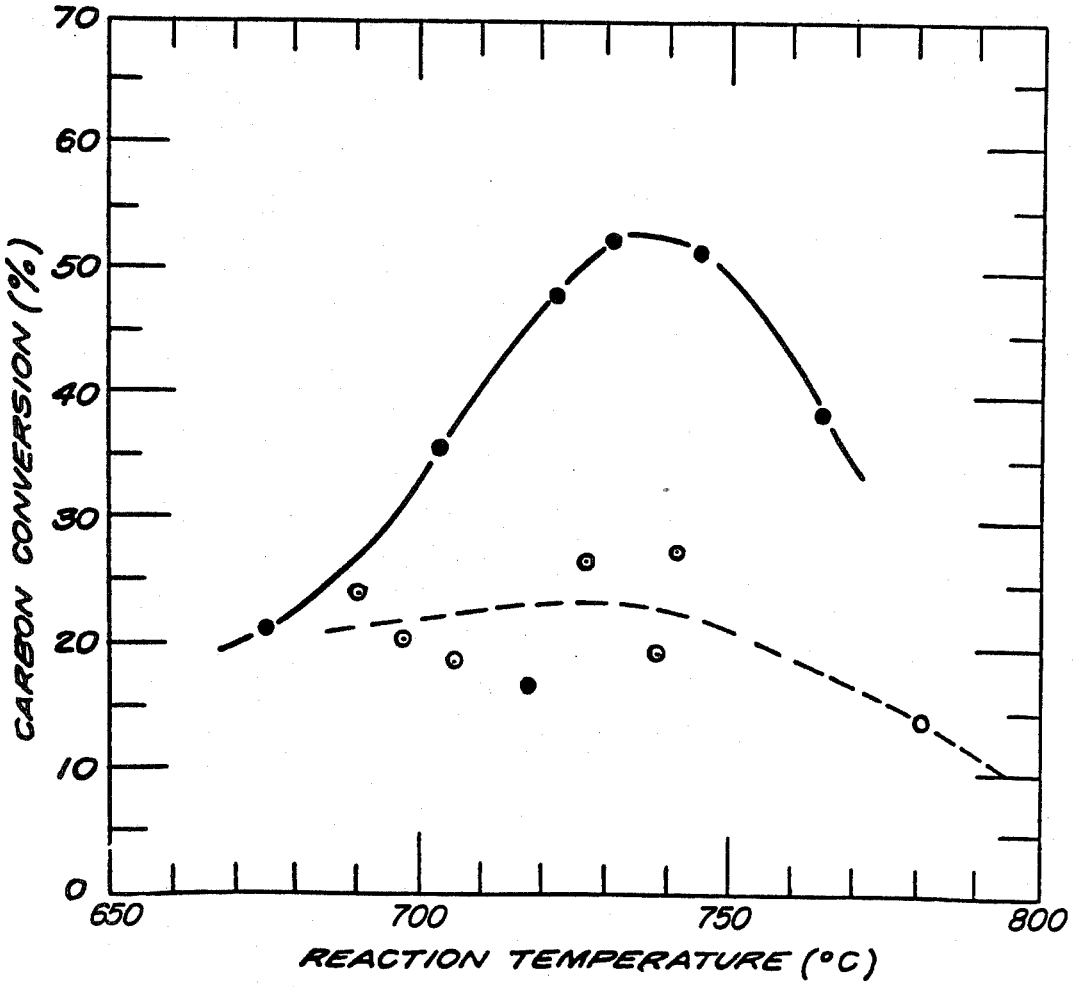
FIG. 2 is a graph showing the percentage carbon conversion to liquids at different pyrolysis temperatures for Illinois No. 6 coal with and without pretreatment of the coal.

The advantages of the two-stage process of this invention will be further illustrated by the following example and with reference to FIG. 2. It is to be understood, however, that this example is merely illustrative and is not to be construed so as to limit the scope of the invention.

EXAMPLE

Two series of experiments were conducted in order to illustrate the increased yields of liquid hydrocarbons which can be obtained by the two-stage process of this invention. These experiments were made on bench scale equipment using Illinois No. 6 coal containing 69.1 weight percent carbon on a dry basis, ground to pass 200 mesh screen.

In the first series of experiments the coal was not pretreated. Approximately 200 mg of raw coal at ambient temperature were injected into the reactor using a brief pulse of helium. The helium serves only to carry the coal into the reactor and does not influence the results in any way. Upon injection into the reactor, the coal entered a continuously flowing stream of superheated steam and was carried on to a trap of quartz chips which retained the coal particles. The coal was flash heated to the temperature of the reactor in a fraction of a second by contact with the superheated steam, radiation from the reactor wall, and direct contact with the trap. Volatile materials released were carried out of the reactor by the flowing steam to an on-line analyzer.

After two minutes the reaction was terminated by flooding the reactor with helium. Thereafter, the amount of carbon remaining as residual char was determined by combustion. The yield of carbon as total volatile product was computed by subtracting the carbon determined to be present in the residual char from the amount of carbon contained in the injected raw coal sample. The yield of carbon obtained as liquid was computed by subtracting the gas yields from the total volatiles yield. The gas yields were the amounts of carbon observed during the steam pyrolysis step as vapors lighter than benzene.

The liquid yields calculated in this manner at various reaction temperatures under a steam pressure of 50 atm are shown as open data points and the dashed line in FIG. 2.

In another series of experiments, the coal was pretreated before being injected into the reactor. In this series the raw coal was exposed to 50 atm of pure steam for thirty minutes at temperatures varying between 300° C. and 370° C. Following this pretreatment, the sample was injected into the reactor as before. In all other respects the experimental procedure was the same as for unpretreated coal. In separate experiments it was determined that about 7% of the coal's mass is lost as volatile material during the pretreatment step. Liquid yields from pretreated coal were calculated as described above for unpretreated coal with the exception that an additional 7% was subtracted from the total volatiles to account for pretreatment losses. Since some of these pretreatment volatiles are liquids, the liquid yields are actually slightly higher than the yields obtained for pretreated coals, by the above calculation.

Liquid yields from pretreated coals are shown in FIG. 2 as closed data points and a solid line. When these are compared with data for unpretreated coals, it is immediately evident that the pretreatment process has increased liquid yields by more than a factor of two.

While the two-stage process of this invention has been described with some degree of particularity, several variations may be made therein which are nevertheless obvious from the present description. Thus, the process of this invention may be carried out continuously, semi-continuously or in batchwise fashion, although, from practical standpoint, continuous operation is preferable and more advantageous.

Also, as was previously mentioned, the increased yields of synfuels can be realized without resort to a catalyst either during pretreatment of the carbonaceous material or pyrolysis of the pretreated coal. If desired, however, either stage may be carried out in the presence of an appropriate catalyst to further enhance the yield and/or economic value of the synfuels. Similarly, no hydrogen is required in the process of this invention but, if desired, the liquid hydrocarbons may be hydrogenated to further upgrade their fuel value, or either the pyrolysis or pretreatment step may be conducted in the presence of hydrogen for this purpose. However, it must be emphasized that improved yields of synfuels can be obtained even without a catalyst and/or hydrogen provided the carbonaceous solids are pretreated prior to pyrolysis as hereinbefore described.

Additionally, even though the process of this invention has been described with reference to two zones, i.e., a pretreatment zone and a pyrolysis zone, both pretreatment and pyrolysis may be carried out in one reactor, if desired. In such a case, the carbonaceous material is first pretreated as aforesaid. After completion of the pretreatment stage, the reactor may be purged to remove the gaseous product produced in this stage and the pretreated carbonaceous material is then pyrolyzed under the conditions which were previously described.

Alternatively, the process of this invention may be carried out in a single reactor consisting of two zones wherein the pretreatment of the carbonaceous materials is carried out in one zone followed by pyrolysis of the pretreated carbonaceous materials in the other zone.

It is apparent from the foregoing description that several other changes and/or modifications may be made in the process of this invention which are obvious from this disclosure. These changes and/or modifications, which may include the type of carbonaceous materials which are used; and whether these materials are used in solid particulate form, a slurry of some other form, are nevertheless within the general scope of this invention and are within the present disclosure.

What is claimed is:

1. A process for the production of liquid hydrocarbon fuels from a carbonaceous material which consists of:

(a) pretreating said carbonaceous material with a gas selected from the group consisting of steam, inert gases, carbon monoxide and mixtures thereof, in the absence of added hydrogen at a temperature of from about 280° C. to about 370° C., under a pressure of from about 1 to about 100 atmospheres, for a period of about a fraction of a second to about 30 minutes, (b) pyrolyzing said pretreated carbonaceous material in the presence of a gas selected from the group consisting of steam, nitrogen, helium, carbon monoxide, combustion gases, pyrolysis gases and mixtures thereof, and (c) recovering liquid hydrocarbons from said pyrolysis products.

2. A process as in claim 1 wherein pretreatment of said carbonaceous material is carried out at a temperature of from about 320° C. to about 370° C.

3. A process as in claim 1 wherein said pyrolysis is carried out at a temperature of from about 500° C. to about 1000° C.

4. A process as in claim 2 wherein said pyrolysis is carried out at a temperature of from about 500° C. to about 1000° C.

5. A process as in claim 1, 2, 3 or 4 wherein said carbonaceous material is pretreated at a pressure of from about 30 to about 80 atmospheres.

6. A process for recovering liquid hydrocarbon values of a carbonaceous material which consists of:

(a) continuously contacting said carbonaceous material with a gas, in a pretreatment zone, said gas being selected from the group consisting of steam, inert gases, carbon monoxide and mixtures thereof, in the absence of added hydrogen at a pressure of from about 1 to about 100 atmospheres, temperature of from about 280° C. to about 370° C. for a period of from about a fraction of a second to about 30 minutes, (b) continuously pyrolyzing pretreated carbonaceous material in a gas selected from the group consisting of steam, helium, nitrogen, carbon monoxide, combustion gases, pyrolysis gases and mixtures thereof, and (c) recovering liquid hydrocarbons from said pyrolysis products.

7. A process as in claim 6 wherein pretreatment of said carbonaceous material is carried out at a temperature of from about 320° C. to about 370° C.

8. A process as in claim 6 wherein said pyrolysis is carried out at a temperature of from about 500° C. to about 1000° C.

9. A process as in claim 7 wherein said pyrolysis is carried out at a temperature of from about 500° C. to about 1000° C.

10. A process as in claim 6, 7, 8 or 9 wherein said carbonaceous material is treated at a pressure of from about 30 to about 80 atmospheres.

11. A process for the production of liquid hydrocarbon fuels from coal which consists of:

(a) pretreating the coal with a gas selected from the group consisting of steam, inert gases, carbon monoxide and mixtures thereof, in the absence of added hydrogen, at a temperature of from about 280° C. to about 370° C. under a pressure of from about 1 to about 100 atmospheres, for a period of about a fraction of a second to about 30 minutes;

(b) pyrolizing said pretreated coal in the presence of a gas selected from the group consisting of steam, nitrogen, helium, carbon monoxide, combustion gases, pyrolysis gases and mixtures thereof, and (c) recovering liquid hydrocarbons from said pyrolysis products.

12. A process as in claim 11 wherein the coal is in particulate form.

13. A process as in claim 11 in which both of steps (a) and (b) are conducted in the absence of hydrogen.

14. A process as in claim 12 in which both of steps (a) and (b) are conducted in the absence of hydrogen.

15. A process for recovering liquid hydrocarbon values from coal which consists of:

(a) continuously contacting coal with a gas in a pretreatment zone, said gas being selected from the group consisting of steam, inert gases, carbon monoxide and mixtures thereof, and in the absence of added hydrogen in said pretreatment zone, at a pressure of from about 1 to 100 atmospheres, and a temperature of from about 280° C. to about 370° C. for a period of about a fraction of a second to about 30 minutes;

(b) continuously pyrolyzing said pretreated coal in a gas selected from the group consisting of steam, nitrogen, helium, carbon monoxide, combusion gases, pyrolysis gases and mixtures thereof, and (c) recovering liquid hydrocarbons from said pyrolysis products.

16. A process as in claim 15 wherein the coal is in particulate form.

17. A process as in claim 15 in which both of steps (a) and (b) are conducted in the absence of hydrogen.

18. A process as in claim 16 in which both of steps (a) and (b) are conducted in the absence of hydrogen.

* * * * *